US005450726A

United States Patent [19]

Higgins

[11] Patent Number: 5,450,726

[45] Date of Patent: Sep. 19, 1995

[54] THERMAL ELECTRIC AIR COOLING APPARATUS AND METHOD

[75] Inventor: Robert W. Higgins, San Jose, Calif.

[73] Assignee: Noah Precision, Inc., San Jose, Calif.

[21] Appl. No.: 92,560

[22] Filed: Jul. 16, 1993

[51] Int. Cl.[6] ..... F25B 21/02

[52] U.S. Cl. ..... 62/3.4; 165/3; 165/65

[58] Field of Search ..... 62/3.2, 3.4, 3.7; 136/204; 165/3, 65, 921

[56] References Cited

U.S. PATENT DOCUMENTS

| | | | |
|---|---|---|---|
| 1,984,658 | 12/1934 | Rourke | 165/3 |
| 2,837,899 | 6/1958 | Lindenblad | 62/1 |
| 2,970,450 | 2/1961 | Roeder, Jr. et al. | 62/3.2 |
| 3,008,300 | 11/1961 | Ryan et al. | 62/3.2 |
| 3,111,166 | 11/1963 | Munz et al. | 62/3.3 |
| 3,126,710 | 3/1964 | Boehmer et al. | 62/3.4 |
| 3,139,734 | 7/1964 | Kuckens et al. | 62/3.2 |
| 3,178,895 | 4/1965 | Mole et al. | 62/3.2 |
| 3,196,620 | 7/1965 | Elfving et al. | 62/3.2 |
| 3,197,342 | 7/1965 | Neild, Jr. | 136/4 |
| 3,241,603 | 3/1966 | Nagata | 62/3.3 |
| 4,253,515 | 3/1981 | Swiatosz | 165/61 |
| 4,306,426 | 12/1981 | Berthet et al. | 62/3.2 |
| 4,400,948 | 8/1983 | Moorehead | 62/3.3 |
| 4,509,586 | 4/1985 | Watabe | 165/29 |
| 4,548,259 | 10/1985 | Tezuka et al. | 165/14 |
| 4,593,529 | 6/1986 | Birochik | 62/3.2 |
| 4,685,303 | 8/1987 | Branc et al. | 62/3.3 |
| 4,829,771 | 5/1989 | Koslow et al. | 62/3.64 |
| 4,833,888 | 5/1989 | Kerner et al. | 62/3.3 |
| 4,977,953 | 12/1990 | Yamagishi et al. | 165/10 |
| 4,987,952 | 1/1991 | Beal et al. | 165/16 |
| 4,989,626 | 2/1991 | Takagi et al. | 137/13 |
| 5,029,445 | 7/1991 | Higgins et al. | 62/3.2 |
| 5,063,582 | 11/1991 | Mori et al. | 378/34 |
| 5,119,640 | 6/1992 | Conrad | 62/3.4 |
| 5,154,661 | 10/1992 | Higgins | 62/3.2 |

FOREIGN PATENT DOCUMENTS

| | | | |
|---|---|---|---|
| 113951 | 9/1979 | Japan | 62/3.2 |

*Primary Examiner*—Henry A. Bennet
*Assistant Examiner*—William C. Doerrler
*Attorney, Agent, or Firm*—Flehr, Hohbach, Test, Albritton & Herbert

[57] ABSTRACT

A method for cooling air to a predetermined outflow temperature for use in an atmosphere having a controlled humidity. In the method, a stream of air having an unknown temperature and an unknown humidity content is supplied. The air is cooled to provide cooled air having a temperature at or below the predetermined outflow temperature. The cooled air is heated when necessary to provide outgoing air having a temperature approximately equal to the predetermined outflow temperature.

19 Claims, 2 Drawing Sheets

THERMAL ELECTRIC AIR COOLING APPARATUS AND METHOD

This invention pertains generally to air cooling systems and, more specifically, to air cooling systems which operate without refrigerants.

Air cooling systems have been provided for use with climate or environmental control systems in the semiconductor and other industries where the temperature and humidity of the air are important for producing products within precise tolerances. Most of these air cooling systems suffer from the disadvantage of using undesirable refrigerants such as freon and chlorofluorocarbons. Many of these refrigerants have been found to be environmentally undesirable. In addition, many of these air cooling systems have reliability problems when they are operated at temperatures below dew point. During such operation, condensation tends to form and freeze on the capillary tubes of the system causing them to rupture. In general, these air cooling systems are capable of cooling a stream of air to a predetermined temperature within a tolerance of only plus or minus two degrees Centigrade.

In general, it is an object of the present invention to provide a new and improved air cooling system and a method for operating the same.

Another object of the invention is to provide a system of the above character in which thermal electronics are utilized to transfer cooling to the air.

Another object of the invention is to provide a system of the above character which does not generate particles.

Another object of the invention is to provide a system of the above character which is reliable and efficient.

These and other objects are achieved in accordance with the invention by providing a method for cooling air to a predetermined outflow temperature for use in an atmosphere having a controlled humidity. In the method, a stream of air having an unknown temperature and an unknown humidity content is supplied. The air is cooled to provide cooled air having a temperature at or below the predetermined outflow temperature. The cooled air is heated when necessary to provide outgoing air having a temperature approximately equal to the predetermined outflow temperature.

Figure 1:
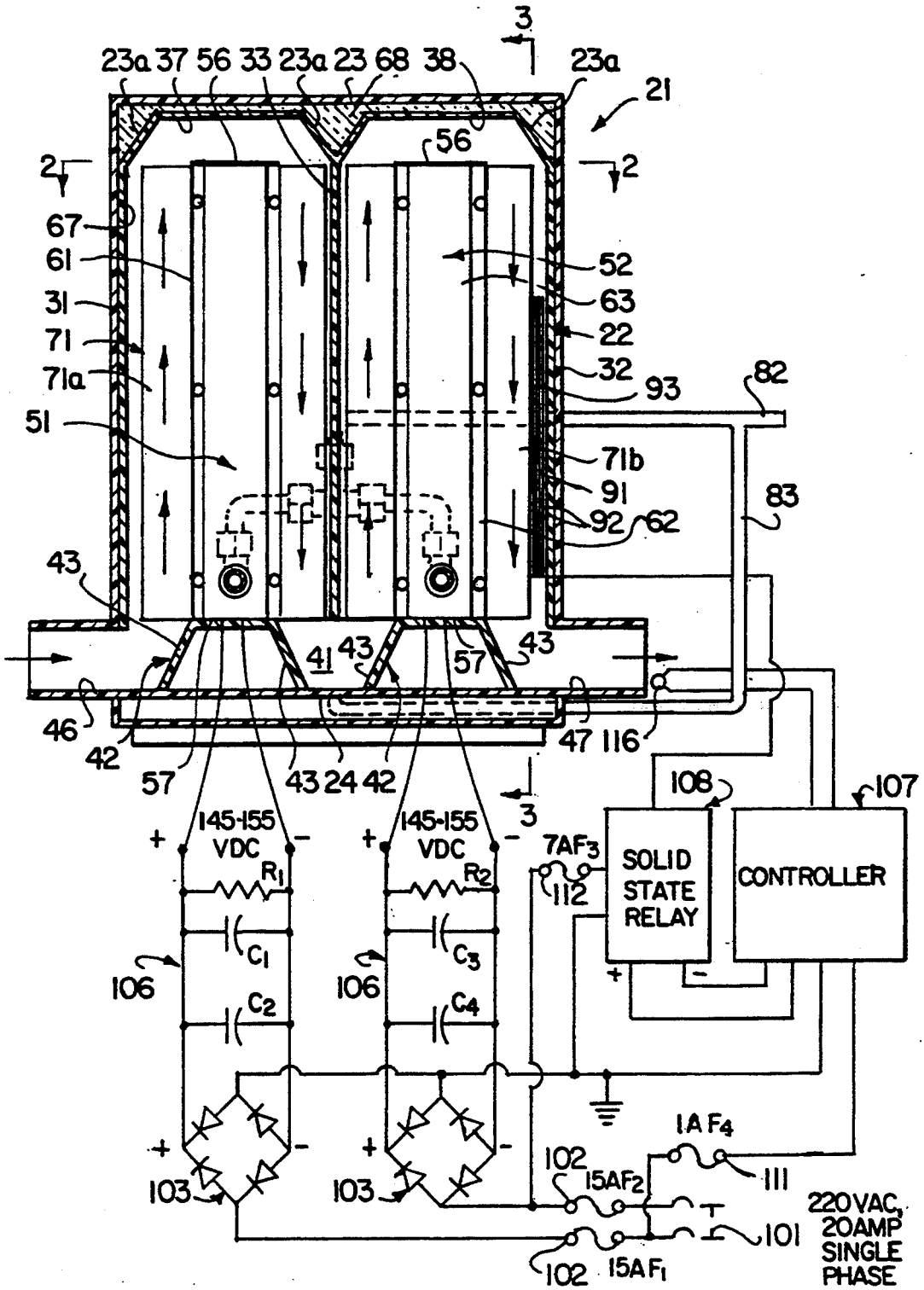
FIG. 1 is a side cross-sectional view of the system for cooling air of the present invention which includes the power and control diagram for operating same.

The thermal electric air cooling system 21 and method of the present invention is for cooling a stream or flow of air to a predetermined outflow temperature and is for use in an atmosphere having a controlled temperature and/or humidity. Air cooling system 21 can be used as part of a climate or environmental control system of the type used in track systems in the semiconductor industry.

System 21 includes a shell or housing 22 made of any suitable material such as plastic. Housing 22 is generally in the form of a parallelepiped and has first or top and second or bottom ends 23 and 24, opposite and generally parallel first and second side walls 26 and 27 and opposite and generally parallel third and fourth side walls 31 and 32. An inner wall 33 which is generally parallel to third and fourth walls 31 and 32 extends perpendicularly between first and second walls 26 and 27 and downwardly from top end 23 to form first and second compartments 37 and 38 in housing 22. Inner wall 33 does not extend to bottom end 24, being provided with an opening 41 at the bottom thereof which connects first and second compartments 37 and 38. First and second platforms 42 extend from the bottom of housing 22 into first and second compartments 37 and 38, respectively. Platforms 42 each include opposite support walls 43 which extend between first and second side walls 26 and 27 and upwardly toward each other at an oblique angle from bottom end 24. An air inlet 46 is provided at the bottom of third side wall 31 and an air outlet 47 is provided at the bottom of fourth side wall 32.

Figure 2:
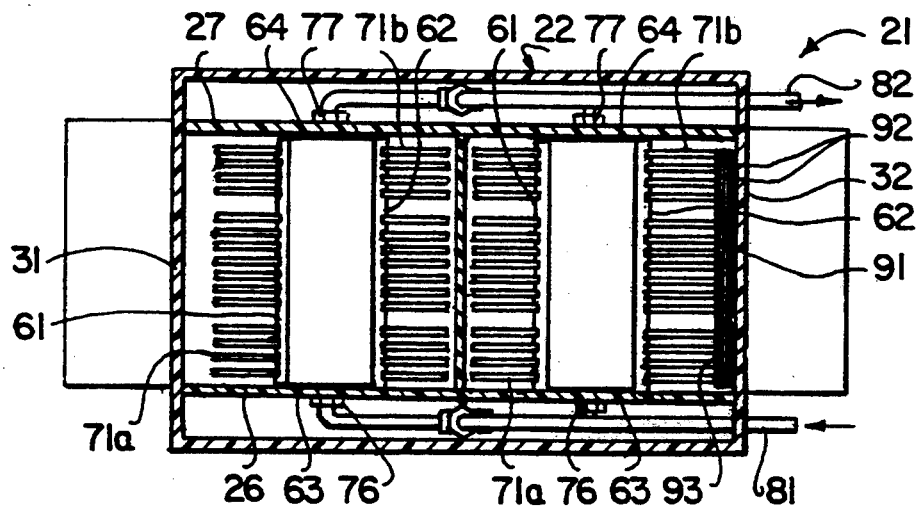
FIG. 2 is a cross-sectional view taken along the line 2—2 of FIG. 1.
Figure 3:
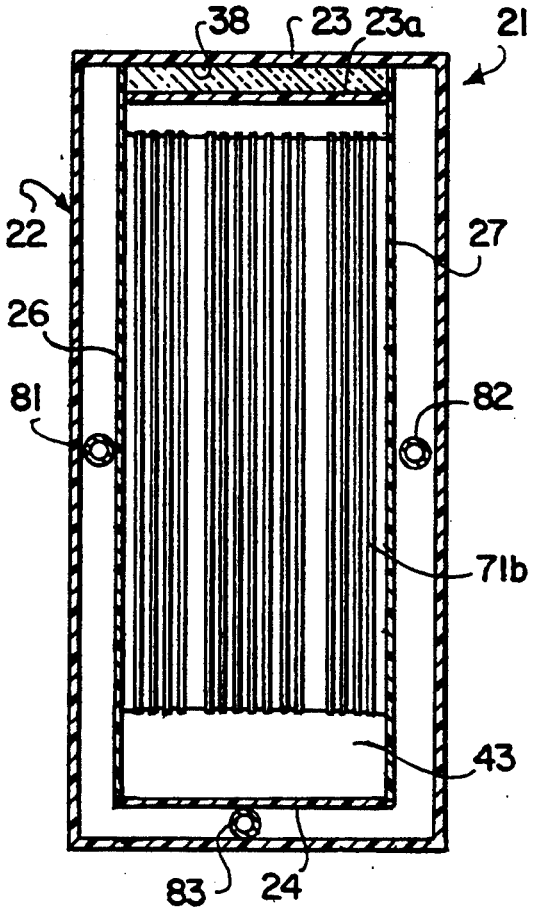
FIG. 3 is a cross-sectional view taken along the line 3—3 of FIG. 1.

At least one and as shown in FIGS. 1 through 3 first and second thermal electric coolers 51 and 52 are included within air cooling system 21 and serve as thermal electric cooling means. Thermal electric coolers 51 and 52 are of a conventional type such as described in U.S. Pat. No. 5,029,445 issued on Jul. 9, 1991, and each have ten thermal electric modules therein. Each thermal electric cooler 51 and 52 is generally in the form of a parallelepiped, having first or top and second or bottom ends 56 and 57 and longitudinally extending opposite and generally parallel first and second sides 61 and 62 and opposite and generally parallel third and fourth sides 63 and 64.

First and second thermal electric coolers 51 and 52 are disposed in respective first and second compartments 37 and 38 of housing 22 in a manner so as to create a serpentine flow passage 67 through the compartments. More specifically, bottom ends 57 of first and second thermal electric coolers 51 and 52 are disposed on respective platforms 42, being secured thereto by any suitable means such as an adhesive, and top ends 56 are spaced apart from top end 23 of housing 22. Flow passage 67 extends from air inlet 46 up first side 61, around top end 56 and down second side 62 of first thermal electric cooler 51 and, after extending through opening 41 in inner wall 33 of housing 22, up first side 61, around top end 56 and down second side 62 of second thermal electric cooler 52. Housing 22 is provided with end portions **23*a* which extend at an oblique angle between top end 23 and respective third and fourth side walls 31 and 32 and inner wall 33 for further directing the flow of air through flow passage 67. Housing 22 is also provided with a suitable insulation such as foam 68 which is disposed within the walls thereof from reducing energy losses between the air being cooled within air cooling system 21** and the surrounding environment.

Thermal electric coolers 51 and 52 are provided with a plurality of longitudinally extending fins 71 for increasing the air cooling surface thereof. Fins 71 can be made of any suitable heat conducting material such as aluminum and have first and second portions **71*a* and 71*b* spaced apart along flow passage 67. More specifically, first fin portions 71*a* are disposed on first sides 61 of thermal electric coolers 51 and 52 and second fin portions 71*b* are disposed on second sides 62 of the thermal electric coolers. Side walls 26 and 27 and 31 and 32 and inner wall 33 are included within the means of air cooling system 21 for causing the air being cooled thereby to flow over thermal electric coolers 51 and 52 and top and bottom ends 23 and 24 of housing 22** are included within the means of the air cooling system for causing turbulence in the cooled air.

Thermal electric coolers 51 and 52 each include a cooling manifold provided with a serpentine flow passage therethrough. Each cooler 51 and 52 has a first or inlet fitting 76 disposed on third side 63 thereof and extending through first side wall 26 of housing 22 and a second or outlet fittings 77 disposed on fourth side 64 thereof and extending through second side wall 27 of the housing. Inlet and outlet fittings 76 and 77 are in communication with the serpentine flow passage of the cooling manifold and are coupled to respective first or inlet and second or outlet piping or lines 81 and 82 as illustrated in FIGS. 1 and 2. Lines 81 and 82 are connected to a heat or water exchanger and a city water supply in a conventional manner. A capillary or drain tube 83 extends through bottom end 24 of first and second compartments 37 and 38 at one end and connects to outlet line 82 at the other end and serves to drain any condensation or other moisture which has accumulated in the compartments.

Means is included in air cooling system 21 for heating the air cooled by thermal electric coolers 51 and 52 when necessary and includes a generally planar blanket-type heater 91 of a suitable type such as the 500 watt silicone blanket heater made by Wattlow of St. Louis, Mo. as Part No. F050100C-C7-A10D. Blanket heater 91 is sandwiched between first and second aluminum plates 92 and secured to one of plates 92 by an adhesive or any other suitable means. Plates 92 are approximately one-eighth inch in thickness and are secured together by a bead of silicone extending around the edges thereof. Plates 92 serve to protect blanket heater 91 from condensation or moisture within compartments 37 and 38 and to prevent electrical energy from leaking from the blanket heater into air cooling system 21. Means is provided for securing blanket heater 91 and plates 92 to one of fins 71 and includes thermal epoxy 93. More specifically, one of plates 92 is welded by thermal epoxy 93 to the outside of fin second portion **71*b* of second thermal electric cooler 52**.

Air cooling system 21 is powered by two legs of single phase 20 amperes alternating current at 220 volts each as shown in FIG. 1. A dipole circuit breaker 101 is provided between the two legs and each of the legs is provided with a 15 ampere fuse 102 thereon. Each leg is converted to direct current having approximately 145 to 155 volts for powering one of the first and second thermal electric coolers 51 and 52. Conversion to direct current is accomplished by each leg passing through a conventional bridge rectifier 103 and an RC filter 106 consisting of one resistor R1 and two capacitors C1 and C2 for first thermal electric cooler 51 and one resistor R2 and two capacitors C3 and C4 for second thermal electric cooler 52.

A controller 107 and a solid state relay 108 are included within the means for controlling the temperature of the air cooled by air cooling system 21. Controller 107 is of the type made by Wattlow and is electrically connected to one of the 20 ampere alternating current legs, the interconnection provided with a one ampere fuse 111 therein. Solid state relay 108 is electrically connected to the other 20 ampere alternating current leg, the interconnection provided with a seven ampere fuse 112 therein. Controller 107 is electrically connected to a heat sensing thermocouple 116 disposed in air outlet 47 and included within the means of air cooling system 21 for sensing the temperature of the air cooled thereby. It should be appreciated that thermocouple 116 can be placed elsewhere in flow passage 67 for sensing the temperature of the air thereat and be within the scope of the present invention. Solid state relay 108 is connected to blanket heater 91 for providing electrical power thereto and is also connected to controller 107 for receiving plus and minus logic signals therefrom for indicating when electrical power to the blanket heater should be turned on or off.

In operation and use, the method of air controlling system 21 includes supplying a stream of air having an unknown temperature and an unknown humidity content to air inlet 46. The predetermined outflow temperature to which the stream of air is to be cooled is programmed into controller 107. As the stream of air travels through the serpentine flow passage 67 of air cooling system 21, it passes sequentially over first and second fin portions **71*a* and 71*b* of first thermal electric cooler 51 and then first and second fin portions 71*a* and 71*b* of second thermal electric cooler 52. Fins 71 serve as a heat sink, extracting heat from the stream of air and thus cooling it. The heat extracted from the air is removed from housing 22 by the water passing through the cooling manifolds within thermal electric coolers 51 and 52. The turbulence created in the stream of air as it changes directions in first and second compartments 37 and 38 and travels over fins 71** serves to disrupt the laminar air flow and contribute to a generally uniform and consistent temperature within the air being cooled.

First and second thermal electric coolers 51 and 52 cool the stream of air to provide cooled air having a temperature at or below the predetermined outflow temperature. In this regard, the stream of air cooled by thermal electric coolers 51 and 52 has a temperature below zero degrees Centigrade and, more specifically, approximating −5 degrees Centigrade at an air flow of approximately 130 cubic feet per minute. Because the stream of air is cooled to a temperature below dew point, air cooling system 21 serves to also dehumidify the air by causing the moisture therein to precipitate. The resulting condensation accumulates on fins 71 and flows to the bottom of first and second compartments 37 and 38. Air cooling system 21 is not harmed by any condensation which freezes on fins 71 because there are no liquid carrying tubes or capillaries extending therein. The negative pressure created in drain tube 83 by the water passing through outlet line 82 serves to suck the condensed water from the bottom of compartments 37 and 38 into outlet line 82.

The cooled air provided by first and second thermal electric coolers 51 and 52 is heated when necessary to provide outgoing air having a temperature approximately equal to the desired predetermined outflow temperature. Many users of air cooling system 21 desire an outflow temperature ranging from approximately 3 degrees to 10 degrees Centigrade. Thermocouple 116 senses the outgoing air to ascertain the temperature thereof and to determine whether the cooled air provided by thermal electric coolers 51 and 52 must be heated to provide outgoing air at the desired predetermined outflow temperature. The temperature of the outgoing air so sensed by thermocouple 116 is relayed to controller 107 where it is compared to the desired outflow temperature programmed therein. If the temperature sensed is too low, controller 107 signals solid state relay 108 to activate blanket heater 91 which heats fin second portion **71*b* on second thermal electric cooler 52 so that the temperature of the stream of air passing therethrough is elevated. Once the temperature of the outgoing air sensed by thermocouple 116 has increased to the desired level, controller 107 signals solid state relay 108 to turn off blanket heater 91**.

The outgoing air produced by air cooling system 21 closely approximates the desired outflow temperature and has a generally uniform temperature distribution. By way of example, air cooling system 21 can control the temperature of the outgoing air to within one tenth of a degree Centigrade. The outgoing air also has a known humidity which approximates zero. These known characteristics of the outgoing air permit it to be easily worked on to produce air having a desired temperature and humidity for use in a controlled environment.

Air cooling system 21 is more reliable than current conventional cooling systems. Unlike conventional cooling systems which utilize refrigerants, air cooling system 21 has no fans or other moving parts susceptible to failure. In addition, the inclusion of heating blanket 91 in air cooling system 21 eliminates the need to reverse the polarity of the thermal electric modules within thermal electric coolers 51 and 52 to accomplish heating. Systems requiring polarity reversal to accomplish heating are generally more complex and expensive and less reliable than air cooling system 21.

In view of the foregoing, it can be seen that a new and improved air cooling system and method has been provided in which thermal electronics are utilized to transfer cooling to the air. The thermal electric coolers in the system of the present invention are solid state and have no moving parts. This absence of moving parts increases reliability and reduces downtime. The air cooling system is environmentally more desirable because it does not use conventional refrigerants such as freon and chlorofluorocarbons. There are no compressor noises or particle generating fans.

What is claimed is:

1. A method for cooling a stream of air of unknown temperature and humidity content to a lower predetermined outflow temperature for use in a controlled atmosphere comprising the steps of cooling the stream of air to a temperature below the unknown temperature to provide a cooled stream of dehumidified air, sensing the cooled stream of dehumidified air to determine whether it has a temperature below the predetermined outflow temperature and heating the cooled stream of dehumidified air if necessary so that it has a temperature approximately equal to the predetermined outflow temperature to provide an outgoing stream of dehumidified air of known temperature for use in the controlled atmosphere.

2. The method of claim 1 wherein the sensing and heating steps include controlling the temperature of the outgoing stream of dehumidified air to within one tenth of a degree Centigrade.

3. A method for cooling a continuous stream of air of unknown temperature and humidity content to a lower predetermined outflow temperature for use in a controlled atmosphere comprising the steps of cooling the stream of air to a temperature below the unknown temperature with a thermal electric module to provide a continuous stream of cool dehumidified air, sensing the continuous stream of cool dehumidified air to determine whether it has a temperature below the predetermined outflow temperature and heating the continuous stream of cool dehumidified air if necessary so that it has a temperature approximately equal to the predetermined outflow temperature to provide an outgoing continuous stream of dehumidified air of known temperature for use in the controlled atmosphere.

4. The method of claim 1 wherein the cooling step includes cooling the stream of air to a temperature below zero degrees Centigrade.

5. An apparatus for cooling a stream of air of unknown temperature and humidity content to a lower predetermined outflow temperature for use in a controlled atmosphere comprising a thermal electric module for cooling the stream of air without the use of refrigerants, means for causing the stream of air to flow over the thermal electric module so that the stream of air is cooled to a temperature below the unknown temperature and is dehumidified, a sensor for sensing the temperature of the stream of air cooled and dehumidified by the thermal electric module to determine whether it has a temperature below the predetermined outflow temperature and means for heating the stream of air if necessary so that it has a temperature approximately equal to the predetermined outflow temperature to provide an outgoing stream of dehumidified air of known temperature for use in the controlled atmosphere.

6. An apparatus as in claim 5 together with means for causing turbulence in the stream of air so that the air is of a generally uniform temperature.

7. Apparatus as in claim 5 wherein the heating means includes means independent of the thermal electric module for supplying heat to the stream of air.

8. An apparatus as in claim 7 wherein the thermal electric module is provided with a plurality of conducting fins through which the stream of air flows to be cooled.

9. An apparatus as in claim 8 wherein the conducting fins have first and second portions spaced apart along the stream of air and wherein the heating means is disposed on the second portion.

10. An apparatus as in claim 8 wherein the heating means includes a blanket-type heater and means for securing the blanket-type heater to the conducting fins.

11. An apparatus as in claim 6 together with a controller for controlling the temperature of the outgoing stream of air to within at least one degree Centigrade.

12. An apparatus as in claim 10 wherein the means for securing the blanket-type heater to the conducting fins includes first and second plates for sandwiching the blanket-type heater therebetween and means for securing at least one of the plates to the conducting fins.

13. An apparatus for cooling a continuous stream of air of unknown temperature and humidity content to a lower predetermined outflow temperature for use in a controlled atmosphere, comprising a thermal electric module for cooling the continuous stream of air below the unknown temperature without reversing the polarity of the thermal electric module, means for causing the continuous stream of air to flow over the thermal electric module to produce a continuous stream of dehumidified air having a temperature lower than the unknown temperature and means for heating the continuous stream of dehumidified air when necessary to produce an outgoing continuous stream of dehumidified air having a temperature approximately equal to the predetermined outflow temperature, the operation of the thermal electric module without reversal of the polarity thereof enhancing the reliability of the thermal electric module.

14. An apparatus as in claim 13 wherein the heating means includes an electric heater.

15. The method of claim 1 wherein the cooling step includes continuously cooling the stream of air.

16. The method of claim 3 wherein the heating step includes heating the continuous stream of cool dehumidified air without reversing the polarity of the thermal electric module.

17. The method of claim 3 wherein the heating step includes heating the continuous stream of cool dehumidified air other than with the thermal electric module.

18. The method of claim 3 wherein the cooling step includes cooling the stream of air to a temperature below dew point.

19. The apparatus of claim 5 wherein the thermal electric module consists of a thermal electric module for continuously cooling a stream of air.

* * * * *